US008103197B2

(12) United States Patent
Matsumoto et al.

(10) Patent No.: US 8,103,197 B2
(45) Date of Patent: Jan. 24, 2012

(54) DEVELOPING SYSTEM AND IMAGE FORMING APPARATUS INCORPORATING SAME

(75) Inventors: Junichi Matsumoto, Yokohama (JP); Nobuo Iwata, Sagamihara (JP); Natsumi Katoh, Atsugi (JP); Tomoya Ohmura, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 446 days.

(21) Appl. No.: 12/178,986

(22) Filed: Jul. 24, 2008

(65) Prior Publication Data

US 2009/0028611 A1 Jan. 29, 2009

(30) Foreign Application Priority Data

Jul. 27, 2007 (JP) ..... 2007-196280

(51) Int. Cl.
*G03G 15/08* (2006.01)

(52) U.S. Cl. ..... 399/260; 399/254

(58) Field of Classification Search ..... 399/254, 399/258, 260, 92

See application file for complete search history.

(56) References Cited

U.S. PATENT DOCUMENTS

| | | | | |
|---|---|---|---|---|
| 5,561,506 | A * | 10/1996 | Kasahara | 399/256 |
| 5,797,074 | A * | 8/1998 | Kasahara et al. | 399/262 |
| 7,085,522 | B2 | 8/2006 | Muramatsu et al. | |
| 7,127,198 | B2 | 10/2006 | Muramatsu et al. | |
| 7,346,286 | B2 | 3/2008 | Matsumoto et al. | |
| 7,356,288 | B2 | 4/2008 | Iwata et al. | |
| 2003/0053826 | A1 * | 3/2003 | Bares et al. | 399/258 |
| 2003/0156859 | A1 | 8/2003 | Tamai | |
| 2004/0033088 | A1 | 2/2004 | Muramatsu et al. | |
| 2005/0254861 | A1 * | 11/2005 | Schlageter et al. | 399/258 |
| 2005/0281592 | A1 | 12/2005 | Muramatsu et al. | |
| 2007/0009289 | A1 | 1/2007 | Muramatsu et al. | |
| 2007/0053721 | A1 | 3/2007 | Matsumoto et al. | |
| 2007/0053723 | A1 | 3/2007 | Iwata et al. | |
| 2007/0154242 | A1 | 7/2007 | Matsumoto et al. | |
| 2007/0264053 | A1 | 11/2007 | Iwata et al. | |
| 2007/0274740 | A1 | 11/2007 | Katoh et al. | |

FOREIGN PATENT DOCUMENTS

JP 2003-292156 10/2003

* cited by examiner

*Primary Examiner* — David Gray
*Assistant Examiner* — Rodney Bonnette
(74) *Attorney, Agent, or Firm* — Oblon, Spivak, McClelland, Maier & Neustadt, L.L.P.

(57) ABSTRACT

A developing system includes a developing unit, a mixing container, a rotary feeder, an air pump, and an airflow regulator. The developing unit is configured to convert a latent image into visible form using a developer. The mixing container is separated from the developing unit and is configured to hold and mix part of the developer after use. The rotary feeder is configured to dispense the developer from the mixing container to a delivery path. The air pump is configured to supply compressed air to deliver the dispensed developer to the developing unit through the delivery path. The airflow regulator is located where the rotary feeder connects to the delivery path, and is configured to prevent the compressed air from flowing toward the rotary feeder from the delivery path.

24 Claims, 9 Drawing Sheets

DEVELOPING SYSTEM AND IMAGE FORMING APPARATUS INCORPORATING SAME

CROSS-REFERENCE TO RELATED APPLICATIONS

The present patent application claims priority under 35 U.S.C. §119 from Japanese Patent Application No. 2007-196280 filed on Jul. 27, 2007, the entire contents of which are hereby incorporated by reference herein in their entirety.

BACKGROUND OF THE INVENTION

1. Field of the Invention

The present invention relates to a developing system and an image forming apparatus incorporating same, and more particularly, to a developing system that develops an electrostatic latent image on a photoconductive surface using developer, and an image forming apparatus incorporating such a developing system.

2. Discussion of the Background

In many electrophotographic image forming apparatuses, such as photocopiers, printers, facsimiles, plotters, or multifunctional machines with electrophotographic capabilities, two-component developers formed of toner and carrier particles are widely used to develop a visible toner image from an electrostatic latent image formed on a photoconductive surface.

Typically, a two-component developing system includes a developing process, which converts an electrostatic latent image into visible form using toner, and a replenishing process, which supplies new toner to the developer after use and mixes the replenished material for recirculation to the developing process. In such a configuration where the developer is reclaimed for repeated use, it is important to maintain a constant toner concentration and distribution and a constant electrical charge in the developer throughout the replenishing process, so as to achieve a stable quality of toner images produced by the developing process. For this purpose, a common replenishing process adjusts the toner concentration by supplying toner in an amount determined in proportion to the consumed amount, and subsequently mixes the developer with the toner supply to achieve uniformity of the resulting mixture, in which electrical charges are generated by friction between toner and carrier particles.

In a conventional developing system, the replenishment takes place immediately prior to the developing process, where developer is mixed and charged by rotating screw conveyors in a developer sump located close to a development roller that magnetically attracts the developer being mixed for immediate use in the developing process. When used in an environment with a high toner consumption/supply rate, the close interval between replenishment and development may result in insufficient mixing of the replenished developer, which eventually causes a loss of print quality, such as background smudging and/or toner scattering.

To enhance mixing of two-component developer, a developing system has been proposed having a separate replenishing unit and a developing unit connected by a pneumatic path. A common configuration of such a developing system includes a mixing container and a measuring feeder forming the replenishing unit, and a delivery tube and an air pump forming a pneumatic path that connects the replenishing unit to the separate developing unit.

In use, the mixing container mixes developer with new toner so as to obtain appropriate toner concentration and electrical charges therein as required by the material conditions. The measuring feeder feeds regulated amounts of developer from the mixing container to the pneumatic path, which delivers the particulate material to the developing unit using compressed air. In the pneumatic path, the air pump pressurizes air to generate a positive pressure in the delivery path relative to the developing unit and the mixing container which are in communication therewith and therefore are both under atmospheric pressure. The compressed air thus generated propels the developer from the pressure source to the developing unit along the delivery tube.

Occasionally, the pneumatic path in such a developing system suffers from leakage of compressed air where the delivery tube connects to the replenishing unit, i.e., a dispensing opening of the measuring feeder. Such air leakage naturally causes a reduction in propelling pressure leading to insufficient delivery performance, and the compressed air leaking into the mixing container obstructs the flow of developer from the mixing container to the measuring feeder, resulting in reduction or variation in a particle dispensing rate of the measuring feeder. It is therefore desirable to seal off the dispensing opening of the measuring feeder when there is compressed air flowing in the delivery tube.

One approach to achieving this objective is to provide a measuring feeder with sealing capability. Generally, a measuring feeder for feeding developer material is implemented using a rotary feeder formed of a multi-bladed rotor and a stator surrounding the rotor blades. Such rotary feeders can feed developer in a controlled and regulated manner, but often do not offer the reliable sealing required to prevent air leakage in the pneumatic delivery of particles. A good sealing may be provided by forming the rotor blades of resilient material to fit tightly in the surrounding stator, which, however, seems impractical because rubbing the rotor blades against the stator wall will eventually cause significant degradation of the metering mechanism. Moreover, the resilient blade configuration may not have satisfactory durability when used in a two-component developing system that handles hard carrier particles formed of iron and/or ferrite material.

Consequently, what is needed is a two-component developing system having a replenishing unit with a pneumatic delivery path, which can replenish developer with appropriate toner concentration and electrical charges and supply the replenished material for development in regulated amounts reliably and efficiently. An image forming apparatus incorporating such a developing system would achieve excellent electrophotographic performance with reliable and stable imaging quality.

SUMMARY OF THE INVENTION

Exemplary aspects of the present invention are put forward in view of the above-described circumstances, and provide a novel developing system adapted to develop an electrostatic latent image on a photoconductive surface using developer.

Other exemplary aspects of the present invention provide a novel image forming apparatus incorporating a developing system that develops an electrostatic latent image on a photoconductive surface using developer.

In one exemplary embodiment, the novel developing system includes a developing unit, a mixing container, a rotary feeder, an air pump, and an airflow regulator. The developing unit is configured to convert a latent image into visible form using a developer. The mixing container is separated from the developing unit and is configured to hold and mix part of the developer after use. The rotary feeder is configured to dispense the developer from the mixing container to a delivery path. The air pump is configured to supply compressed air to deliver the dispensed developer to the developing unit through the delivery path. The airflow regulator is located where the rotary feeder connects to the delivery path, and is configured to prevent the compressed air from flowing toward the rotary feeder from the delivery path.

In one exemplary embodiment, the image forming apparatus includes an electrophotographic system and a developing system. The electrophotographic system is configured to form an electrostatic latent image. The developing system includes a developing unit, a mixing container, a rotary feeder, an air pump, and an airflow regulator, and is configured to develop the electrostatic latent image. The developing unit is configured to convert a latent image into visible form using a developer. The mixing container is separated from the developing unit and is configured to hold and mix part of the developer after use. The rotary feeder is configured to dispense the developer from the mixing container to a delivery path. The air pump is configured to supply compressed air to deliver the dispensed developer to the developing unit through the delivery path. The airflow regulator is located where the rotary feeder connects to the delivery path, and is configured to prevent the compressed air from flowing toward the rotary feeder from the delivery path.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
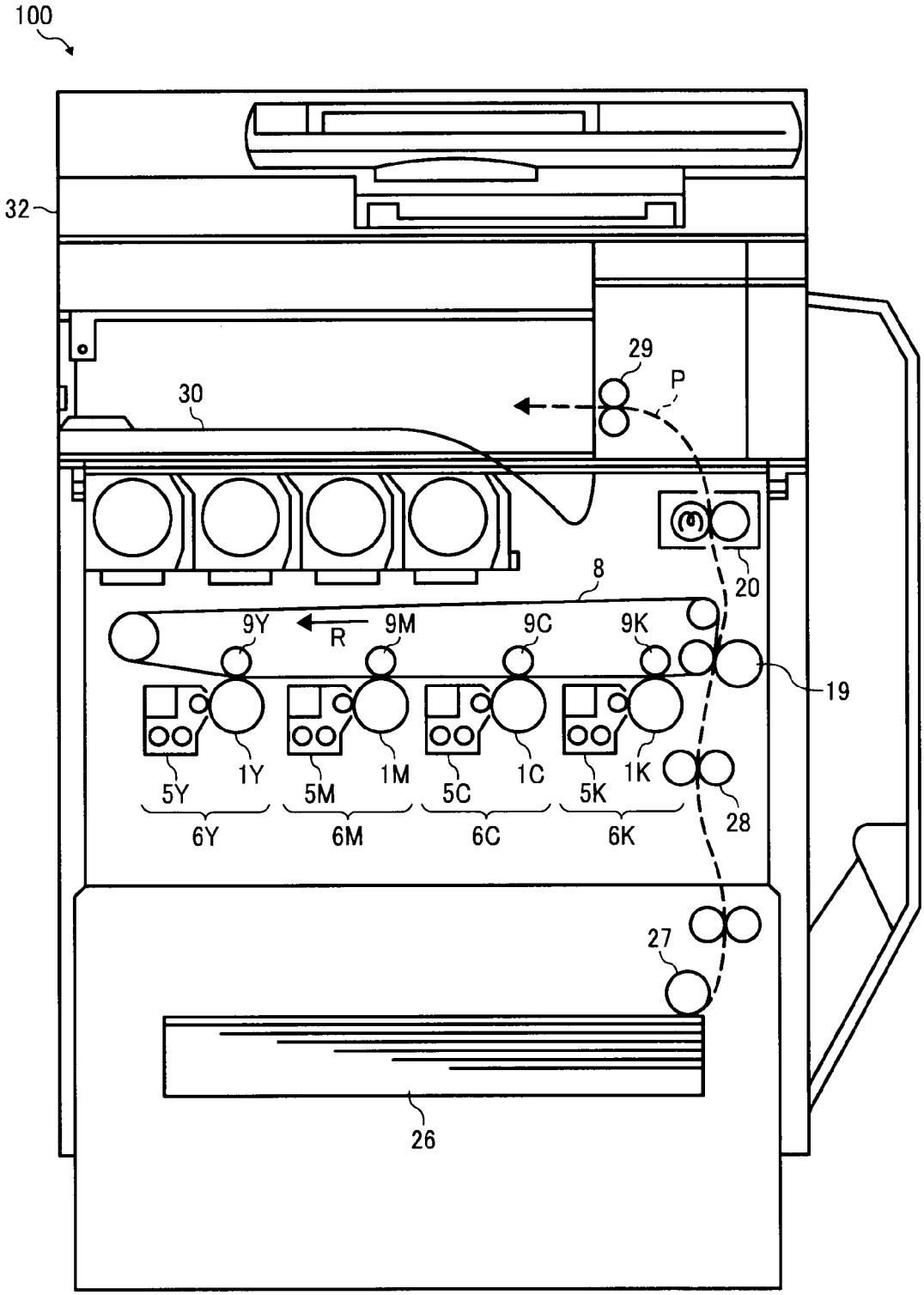
FIG. 1 is a schematic diagram illustrating an image forming apparatus incorporating a developing system according to this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 is a schematic diagram illustrating an image forming apparatus 100 incorporating a developing system according to this patent specification.

As shown FIG. 1, the image forming apparatus 100 includes imaging units 6Y, 6M, 6C, and 6K featuring electrophotographic capabilities. The imaging units 6Y, 6M, 6C, and 6K each includes a photosensitive drum 1Y, 1M, 1C, and 1K and a developing unit 5Y, 5M, 5C, and 5K, respectively, as well as a charge device, a cleaning device, and a discharge roller, which are omitted in the drawing for simplicity.

The imaging units 6Y, 6M, 6C, and 6K are substantially identical in basic configuration and operation, except for the color of toner and image signals provided and used for imaging processes. In the following description, the suffix letters assigned to reference numerals each refers to components associated with a particular toner color used in the image forming apparatus 100, where "Y" denotes yellow, "M" for magenta, "C" for cyan, and "K" for black. These suffixes will be omitted for ease of illustration and explanation where the statements presented are equally applicable to all the components designated by the same reference number.

In the imaging unit 6, the photosensitive drum 1 has a photoconductive surface sequentially surrounded by the charge device, the developing unit 5, the cleaning unit, and the discharge roller, while forming an intermediate transfer nip with an associated one of primary transfer rollers 9Y, 9M, 9C, and 9K through which an image receiving surface or an intermediate transfer belt 8 travels in the direction of arrow R.

In operation, the image forming apparatus 100 electrophotographically forms an image according to image data supplied from an appropriate data source, e.g., an image scanner 32, where the imaging unit 6 rotates the photosensitive drum 1 clockwise in the drawing so as to sequentially forward the photoconductive surface through charging, exposure, development, intermediate transfer, and cleaning processes in a single drum rotation.

First, the charge device uniformly charges the photoconductive surface of the photosensitive drum 1. The charged surface is then exposed to a laser beam emitted from a scanner, not shown, which forms an electrostatic latent image on the photosensitive drum 1 according to an image signal for the corresponding toner color.

The electrostatic latent image thus formed advances to the developing unit 5 as the photosensitive drum 1 rotates. The developing unit 5 develops the latent image into visible form using toner, while communicating with a replenishing process in the developing system as will be described later in more detail.

Then, the developed toner image travels on the photoconductive surface to reach the intermediate transfer nip defined by the photosensitive drum 1 and the primary transfer roller 9. The primary transfer roller 9 is charged with a polarity opposite that applied to the toner particles, so that the toner image is attracted and transferred onto the intermediate transfer belt 8 from the photoconductive surface at the intermediate transfer nip.

After the transfer process, the photoconductive surface is cleared of residual particles by the cleaning device, and discharged and initialized by the discharge roller removing residual charges.

Multiple toner images thus formed by the imaging units 6Y, 6M, 6C, and 6K, respectively, are superimposed one atop another to form a multi-color image on the intermediate transfer belt 8. As the intermediate transfer belt 8 revolves, the multi-color image is advanced to a transfer nip defined between a secondary transfer roller 19 and a suitable backup roller, thereby transferring to a recording sheet being fed into contact with the intermediate transfer belt 8.

In addition to the above electrophotographic imaging components, the image forming apparatus 100 further includes a sheet tray 26 containing a stack of recording media or recording sheets, a pickup roller 27, a pair of registration rollers 28, a pair of output rollers 29, and an output tray 30. The roller components are arranged to form a feed path P along which the recording sheet travels from the sheet tray 26 to the output tray 30, passing through a fixing device 20 also included in the image forming apparatus 100.

During operation, the pickup roller 27 picks up and introduces a single sheet from the sheet tray 26 into the feed path P. The sheet entering the feed path P is first held between the registration rollers 28 and properly aligned, after which it is forwarded in registration to the transfer nip so as to receive the multi-color toner image from the intermediate transfer belt 8.

Then, the recording sheet bearing the powder toner image travels to the fixing device 20, which melts and fixes toner onto the image-bearing surface with a fixing roller and pressure roller, not shown, applying heat and pressure.

After the fixing process, the recording sheet is ejected to the output tray 30 by the output roller 29 and stacked thereon for user pickup.

Figure 2A:
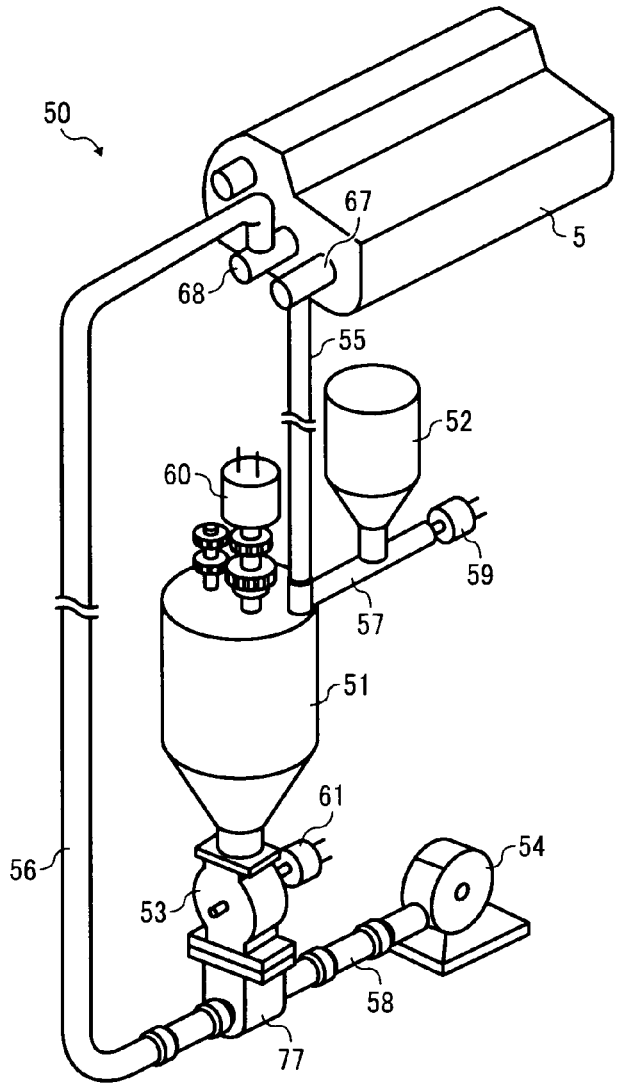
FIGS. 2A and 2B schematically illustrate a general configuration of the developing system incorporated in the image forming apparatus of FIG. 1.
Figure 2B:
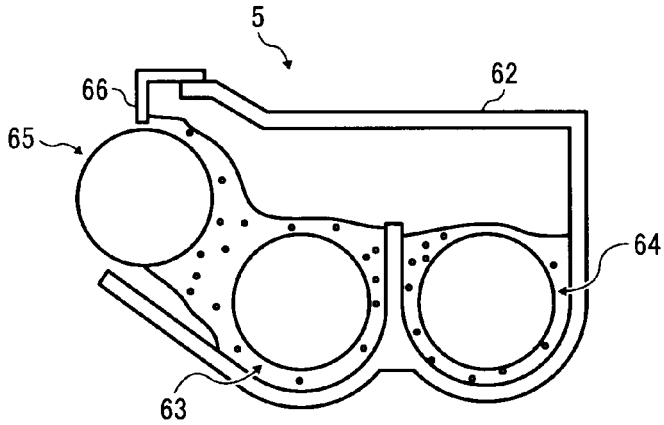

Referring now to FIGS. 2A and 2B, a general configuration of a developing system 50 incorporated in the image forming apparatus 100 according to this patent specification is described.

As shown in FIG. 2A, the developing system 50 includes the developing unit 5 forming part of the imaging unit 6 and provided with an outlet port 67 and an inlet port 68, as well as a mixing hopper 51, a toner cartridge 52, and a rotary feeder 53 located downstream of the developing unit 5. The developing system 50 further includes an air pump 54, a delivery tube 56, and an air tube 58, together forming a delivery path connected to the rotary feeder 53 through a joint tube 77. System components lying behind the developing unit 5 are not shown in FIG. 1 for clarity of illustration.

With reference to FIG. 2B, which provides a latitudinal cross-sectional view, the developing unit 5 includes a housing 62 that defines an elongated reservoir holding a two-component developer formed of toner and carrier particles. The housing 62 supports rotatable screw conveyors 63 and 64 each having a helical flight, as well as a development roller 65 and a metering blade 66 in the proximity of the photosensitive drum 1, not shown.

In use, the two-component developer circulates within the housing 62 as the screw conveyors 63 and 64 rotate in the developing unit 5. The rotation of the screw conveyor 63 moves the developer along the length of the elongated reservoir in a direction that is perpendicular to the sheet of paper on which the FIG. is drawn, while the development roller 65 magnetically attracts a part of the circulating developer. As the development roller 65 rotates, the metering blade 66 regulates the amount of developer carried thereon to form an even layer of developer particles. The developer layer is then brought into contact with the photosensitive drum 1 bearing an electrostatic latent image, which forms a visible toner image in the electrophotographic developing process.

The developer after use reaches the outlet port 67 disposed adjacent to a downstream end of the screw conveyor 64, where a concentration sensor, not shown, senses and signals the concentration of toner in the developer passing by. The developer thus exiting the developing unit 5 is replenished by supplying and mixing new toner in the mixing hopper 51.

In the developing system 50, the mixing hopper 51 is separated from the developing unit 5, and contains developer reclaimed therefrom through a reclamation path 55. When actuated by a motor 60, the mixing hopper 51 mixes and agitates the contents as will be described with reference to FIGS. 3A and 3B.

The toner cartridge 52 is connected to the mixing hopper 51 via a supply path 57, and dispenses a supply of new toner according to signals transmitted from the concentration sensor of the developing unit 5. The supply path 57 has a motor 59 to rotate an internal screw, not shown, for propelling the supplied particles toward the mixing hopper 51. As shown in the drawing, the reclamation path 55 and the supply path 57 intersect to add toner to developer immediately prior to entrance into the mixing hopper 51.

The rotary feeder 53 is disposed below the mixing hopper 51, and feeds therefrom mixed developer in regulated amounts when actuated by a motor 61. The developer is thus dispensed downstream to the delivery path of the developing system 50, where the air pump 54 generates air pressure to deliver the particles toward the inlet port 68 of the developing unit 5.

Figure 3A:
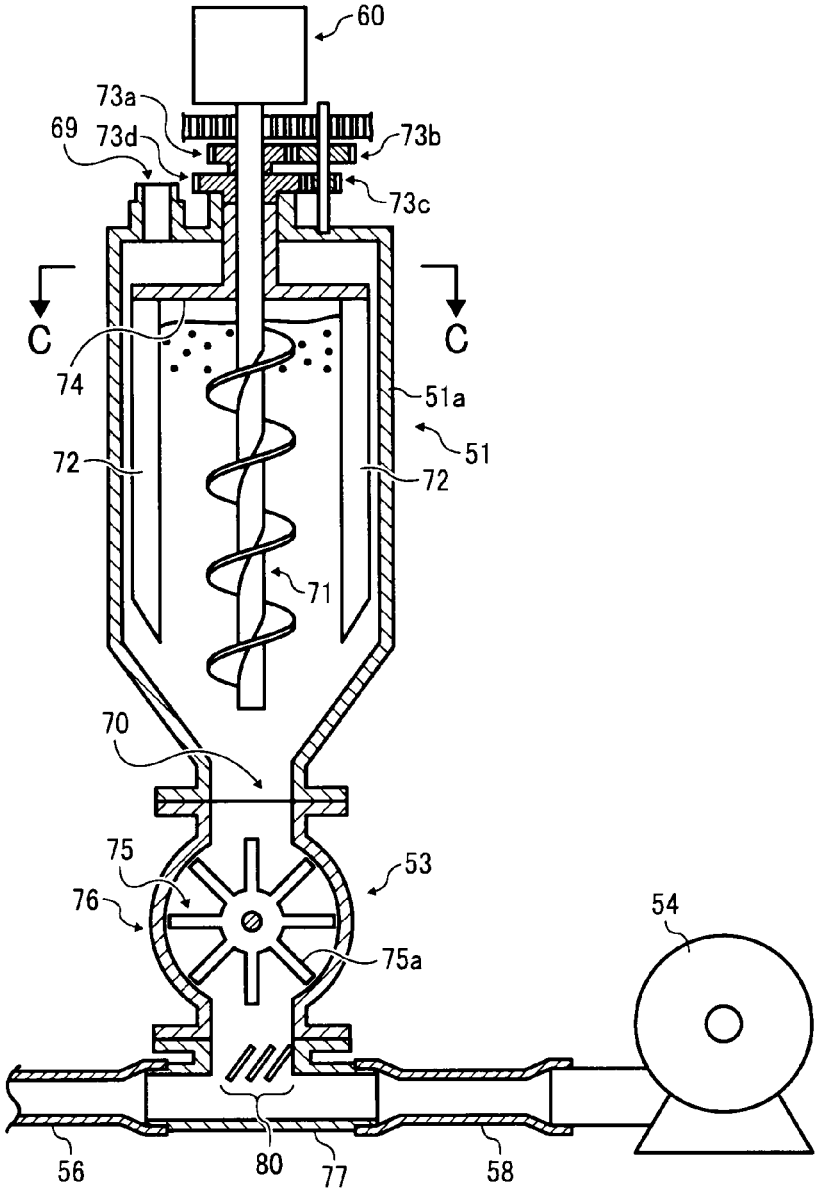
FIGS. 3A and 3B are vertical and horizontal cross-sectional views, respectively, illustrating a mixing hopper in communication with a rotary feeder and a delivery path of the developing system of FIG. 2.
Figure 3B:
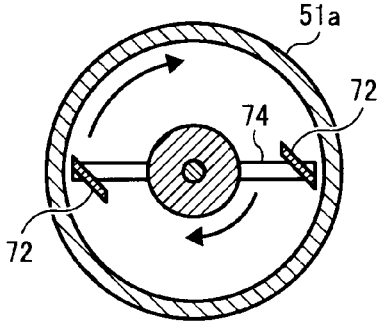

FIGS. 3A and 3B are cross-sectional views illustrating the mixing hopper 51 in communication with the rotary feeder 53 and the delivery path, where FIG. 3A shows a vertical section and FIG. 3B shows a horizontal section taken along line C-C of FIG. 3A.

As shown in FIGS. 3A and 3B, the mixing hopper 51 includes a cylindrical body 51*a* tapering down to the lower end, having an inlet opening 69 on the upper side and an outlet opening 70 on the lower side. The mixing hopper 51 further includes a screw conveyor 71 extending along a center axis of the hopper body 51*a*, and a pair of agitating members 72 supported at an angle on opposite ends of a rotatable arm 74 extending along a diameter of the cylindrical body 51*a*. In the mixing hopper 51, the motor 60 is connected to the screw conveyor 71 directly, and to the arm 74 supporting the pair of agitating members 72 via a train of reduction gears 73*a*, 73*b*, 73*c*, and 73*d*.

The rotary feeder 53 is connected to the outlet opening 70 of the mixing hopper 51, and includes a rotor 75 with radially extending multiple blades 75*a* and a stator 76 surrounding the rotor blades 75*a*. The downward end of the rotary feeder 53 leads to the joint tube 77 coupling the tubes 56 and 58 and forming part of the delivery path.

In operation, the mixing hopper 51 supplies developer with appropriate toner concentration and sufficient electrical charges through mixing with new toner as required by the material conditions. In the mixing hopper 51, the motor 60 imparts rotation to the connected members for moving the contents upwardly with the screw conveyor 71 and radially inward with the agitating members 72. The developer entering the inlet opening 69 travels downward along the cylindrical body 51*a* by gravity, but reaches the outlet opening 70 after being well mixed by the mixing members, since the mixing hopper 51 holds a sufficient stock of developer which serves to isolate the outlet opening 70 from the inlet opening 69.

After the mixing process, the developer exits the mixing hopper 51 to the rotary feeder 53 via the outlet opening 70. When actuated, the rotary feeder 53 rotates the rotor 75 to dispense the incoming developer downward to the joint tube 77. The developer thus dispensed enters a tubular portion of the joint tube 77 via a junction zone where the rotary feeder 53 connects to the delivery path of the developing system 50, and which is provided with an airflow regulator 80 according to this patent specification as will be described later in more detail.

Figure 4:
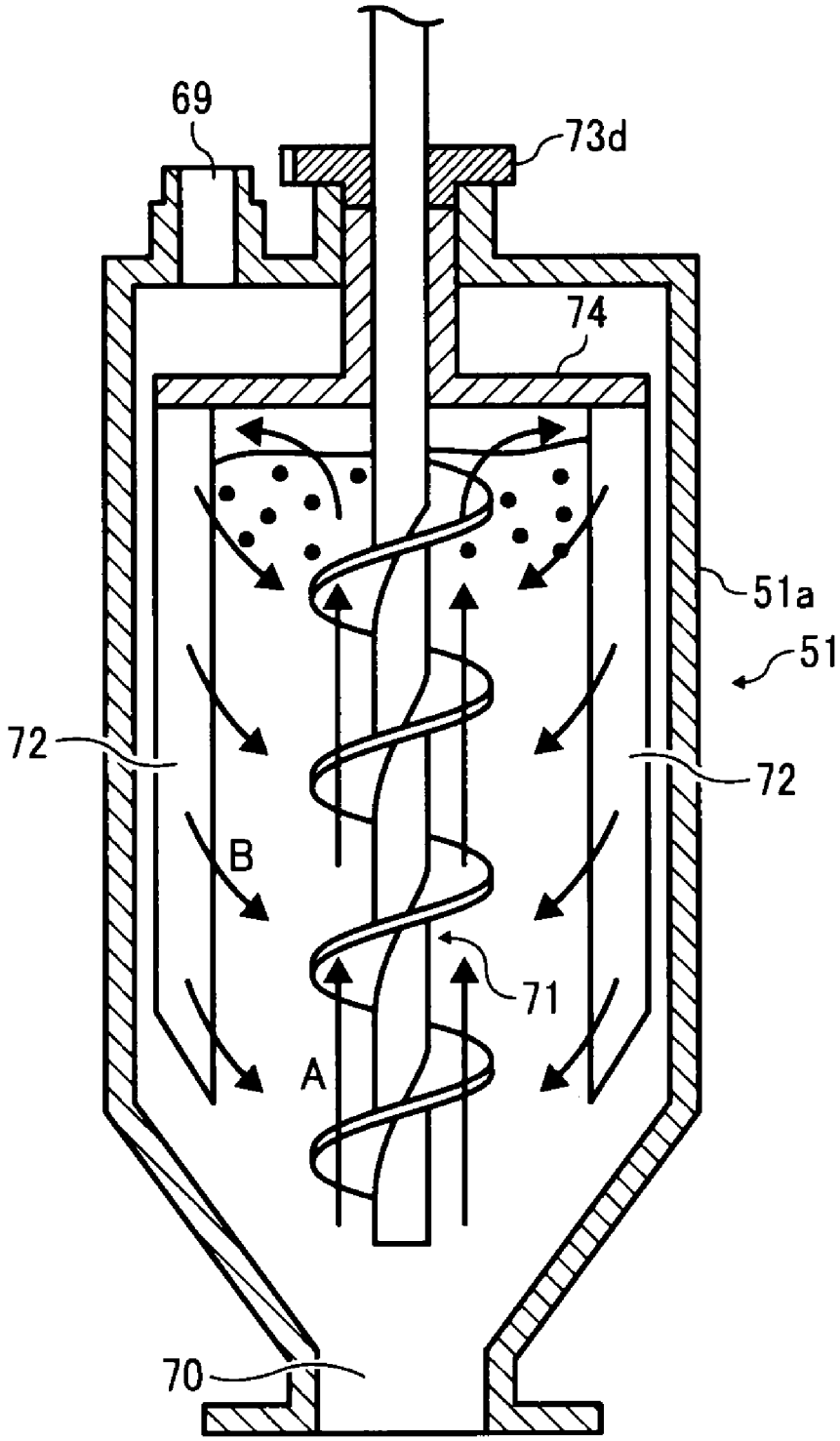
FIG. 4 is a schematic diagram showing developer flowing in the mixing hopper of FIGS. 3A and 3B.

Referring to FIG. 4, a schematic diagram showing the developer flowing in the mixing hopper 51 is briefly depicted.

As shown in FIG. 4, at the center of the mixing hopper 51, the rotation of the screw conveyor 71 causes the developer to flow upward (indicated by arrows A), while at the periphery, the rotation of the agitating members 72 directs the flow of developer toward the center axis of the screw conveyor 71 (indicated by arrows B).

These mixing members generate a constant flow of particles within the mixing hopper 51, which effects good mixing and homogenization of the contents being mixed and agitated. According to a study, such constant flow is also advantageous in obtaining electrical charges swiftly and efficiently, since the constantly flowing toner and carrier particles are quite likely to come into contact with each other to develop triboelectrical charges thereon. It is also noted that such swift and efficient electrification reduces damage to the developer from the mixing/charging process.

Figure 5:
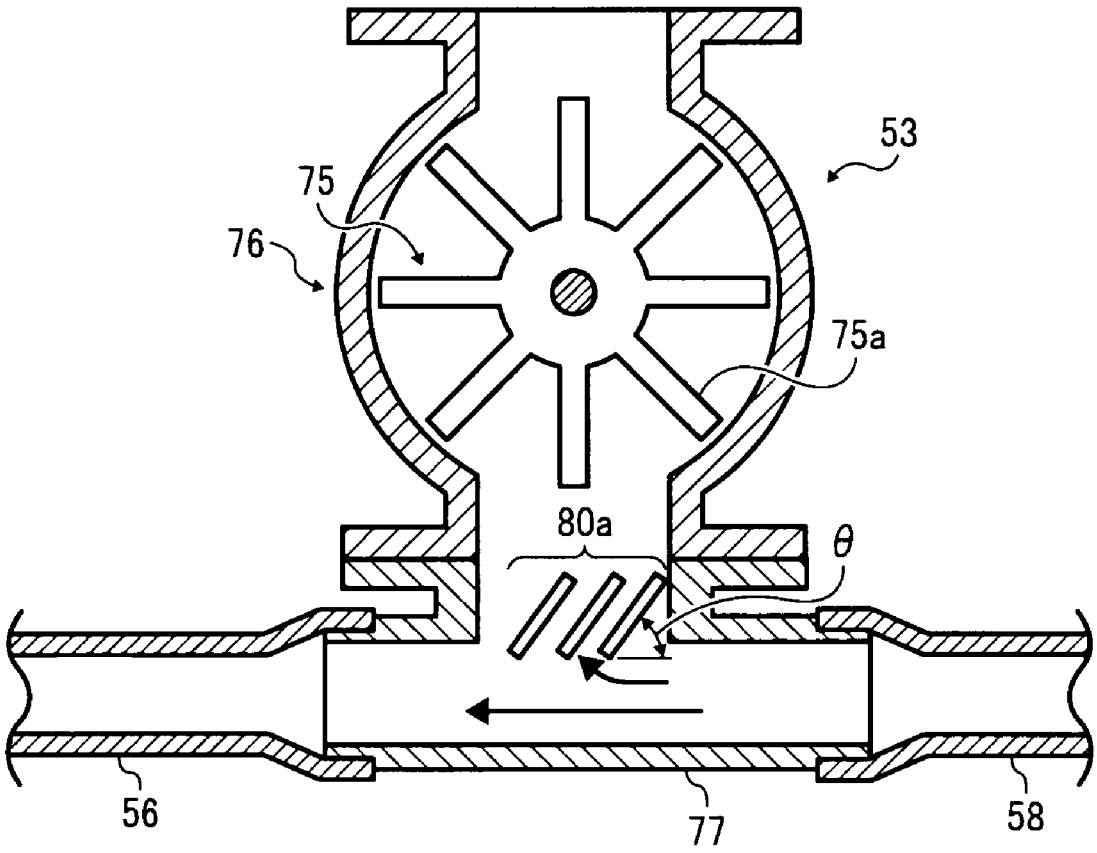
FIG. 5 is a schematic diagram illustrating the rotary feeder equipped with an example of an airflow regulator according to this patent specification.

Referring now to FIG. 5, a schematic diagram illustrating the rotary feeder 53 equipped with an example of an airflow regulator 80*a* according to this patent specification is described.

As shown in FIG. 5, the rotor 75 fits inside the stator 76 with a certain clearance between the tips of the blades 75*a* and the inner surface of the stator 76. The airflow regulator 80*a* includes multiple plates located in the junction zone where the rotary feeder 53 connects to the joint tube 77. The multiple regulating plates are aligned with spacing therebetween, each inclined at an acute angle e relative to the horizontal, i.e., the direction in which the delivery path guides compressed air generated by the air pump 54 to the joint tube 77.

In practice, developer particles entering the rotary feeder 53 from the mixing hopper 51 fill and seal the clearance between the multiple blades 75*a* and the stator 76. When the delivery path has compressed air supplied from the air pump 54, this sealing prevents the compressed air from leaking into the mixing hopper 51 via the rotary feeder 53.

Such a sealing effect of particles is unstable, however, and would fail to prevent air leakage reliably in a configuration with a relatively large clearance between the rotor tips and the stator inner surface. Leaking compressed air from the delivery path into the mixing hopper reduces the amount and pressure of compressed air used to propel particles in the delivery path, and therefore should be avoided in order to achieve efficient delivery of developer in the replenishing process.

In the developing system 50 according to this patent specification, the airflow regulator 80*a* is provided to prevent air from flowing toward the rotary feeder 53 via the junction zone of the joint tube 77.

With reference to FIG. 5, compressed air entering the joint tube 77 from the air pump 54 tends to split into different streams, one flowing toward the upstream rotary feeder 53 and the other flowing toward the delivery tube 56 along the tubular portion of the joint tube 77. The air stream flowing upward is, however, obstructed by the airflow regulator 80*a* at the junction zone, so that little if any of the compressed air can flow into the rotary feeder 53. The angled plate arrangement of the airflow regulator 80*a* effectively hinders air flowing obliquely upward into the junction zone, while allowing particles dispensed from the rotary feeder 53 to enter the tubular portion through spacing between the regulating plates and/or between the regulating plate and the joint tube surface.

Although the number of regulating plates used in the airflow regulator 80*a* is not limited, using multiple plates rather than a single plate provides a higher effect in obstructing the upward flow of air.

Figure 6A:
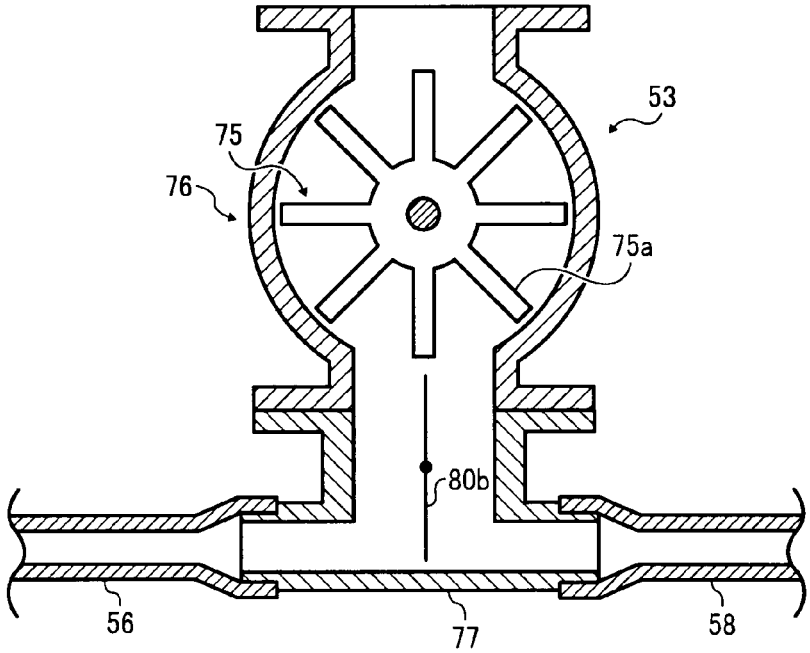
FIGS. 6A and 6B are schematic diagrams illustrating another example of the airflow regulator.
Figure 6B:
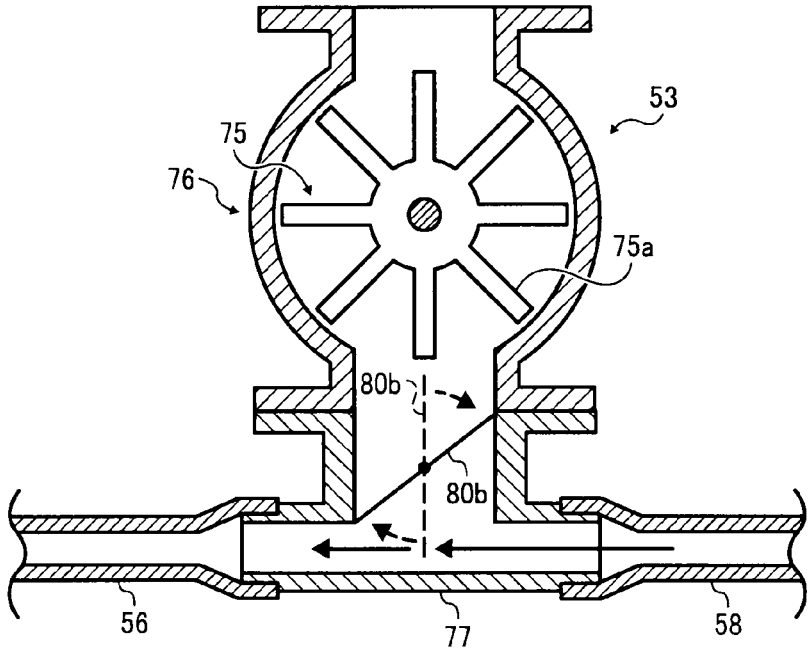

FIGS. 6A and 6B are schematic diagrams illustrating another example of an airflow regulator 80*b*. The airflow regulator 80*b* includes a single plate with a center axis pivotably secured on the inner wall of the joint tube 77.

As shown in FIG. 6A, when there is no airflow supplied from the air pump 54, the airflow regulator 80*b* is in a first position with one end pointing down and extending into the interior of the joint tube 77, which allows particles dispensed from the rotary feeder 53 to pass the junction zone to the delivery path. Although not depicted in the drawing, the first position of the airflow regulator 80*b* is maintained by an appropriate elastic member (e.g., a spring). Alternatively, supporting the first position may be accomplished by using a magnet, or by making the regulating plate self-rightable with a weighted lower end or weighted lower half.

When the air pump 54 starts supplying compressed air to the delivery path, the flow of air causes the airflow regulator 80*b* to swing around the center axis to a second position as shown in FIG. 6B. The airflow regulator 80*b* maintains the second position as long as there is air pressure generated by the air pump 54, thus obstructing upward airflow at the junction zone so that little if any of the compressed air can flow into the rotary feeder 53.

With such an arrangement of the airflow regulator 80*b*, the developing system 50 can effectively deliver developer in the delivery path by periodically activating the air pump 54 to discontinuously supply compressed air with the airflow regulator 80*b* turning between the first and second positions.

This turning plate arrangement can also avoid a possible disadvantage arising from the configuration described in FIGS. 5A and 5B, i.e., arranging the airflow regulator fixed and stationary can obstruct and narrow, if not block up, flow of developer particles passing the junction zone. Obstructing particle flow at the junction zone reduces dispensing rate of the rotary feeder, and accordingly causes a backflow, where dispensed particles remaining at the junction zone flow backward to the rotary feeder. Moreover, narrowing the passage of developer can lead to clogging due to particles forming cross-links therebetween.

In addition, the airflow regulator 80*b* may also include a stop (e.g., a prominence or bar) formed on the inner wall of the joint tube 77, which receives and retains the upper and lower ends of the regulating plate when the airflow regulator 80*b* is in the second position. The stop leaves an appropriate space between the plate edges and the tube wall, which avoids developer particles from getting pinched and damaged by the movement of the regulating plate, but permits little air to flow into the upstream of the junction zone, which is already occupied by a certain amount of particles dispensed from the rotary feeder 53. Such an arrangement is equally applicable to other examples having a regulating plate movable relative to the surrounding walls.

Figure 7A:
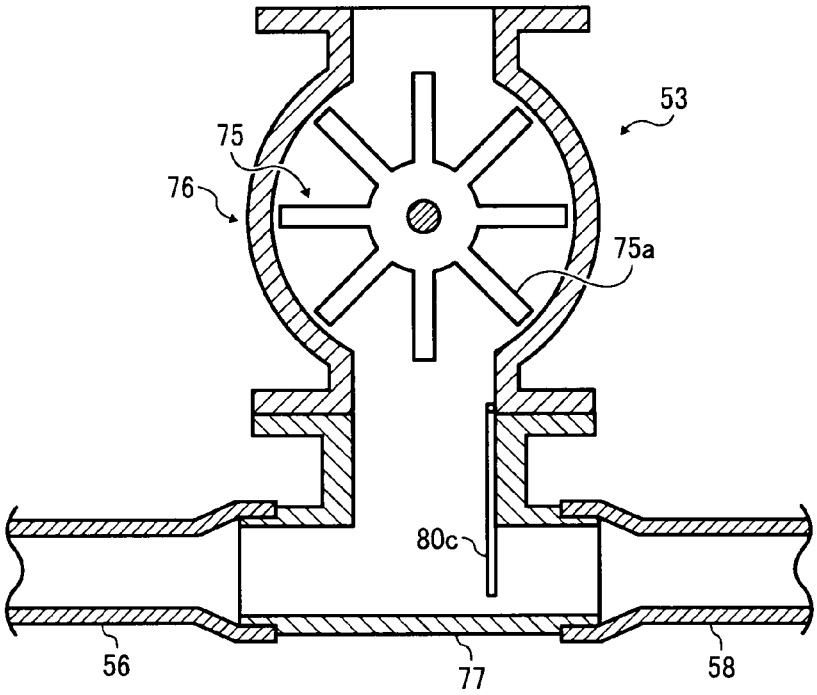
FIGS. 7A and 7B are schematic diagrams illustrating still another example of the airflow regulator.
Figure 7B:
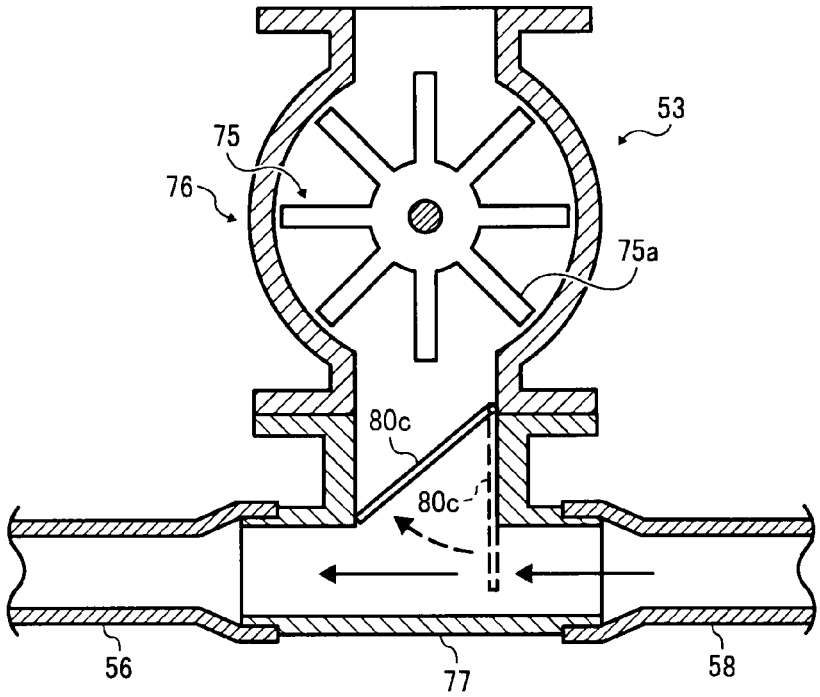

FIGS. 7A and 7B are schematic diagrams illustrating a still another example of an airflow regulator 80*c*. The airflow regulator 80*c* includes a single plate with one end free and another end rotatably supported on the inner wall of the stator 76.

As shown in FIG. 7A, when there is no airflow supplied from the air pump 54, the airflow regulator 80*c* is in a first position with the free end hanging down to reach the tubular portion of the joint tube 77, which allows particles dispensed from the rotary feeder 53 to pass the junction zone to the delivery path. The first position of the airflow regulator 80*c* is maintained by self-weight of the regulating plate.

When the air pump 54 starts supplying compressed air to the delivery path, the airflow regulator 80*c* swings on the supported end to a second position by air pressure as shown in FIG. 7B. The airflow regulator 80*c* maintains the second position as long as there is air pressure generated by the air pump 54, and swings back to the first position by gravity when the air supply stops, thus obstructing upward airflow at the junction zone so that little if any of the compressed air can flow into the rotary feeder 53.

With such an arrangement of the airflow regulator 80*c*, the developing system 50 can effectively deliver developer in the delivery path by periodically activating the air pump 54 to discontinuously supply compressed air with the airflow regulator 80*b* swinging between the first and second positions.

Figure 8A:
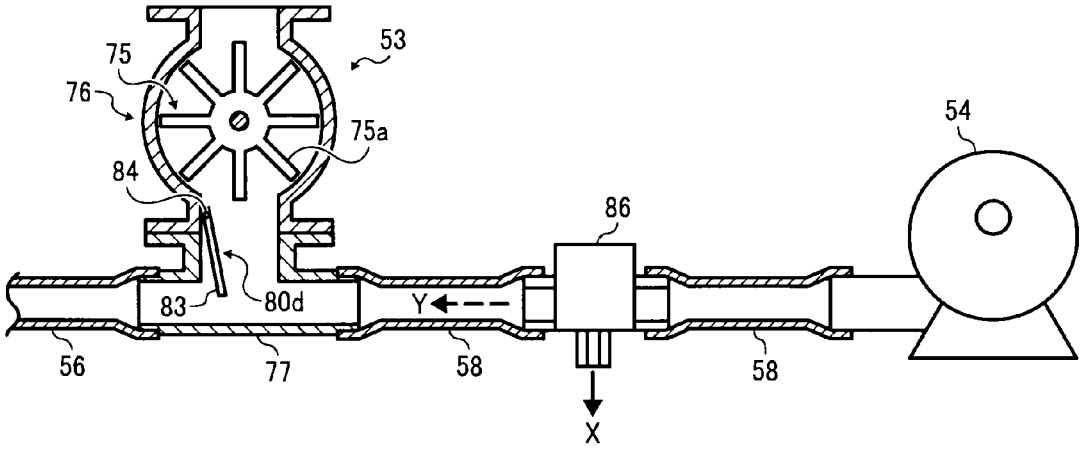
FIGS. 8A through 8C are schematic diagrams illustrating still another example of the airflow regulator.
Figure 8B:
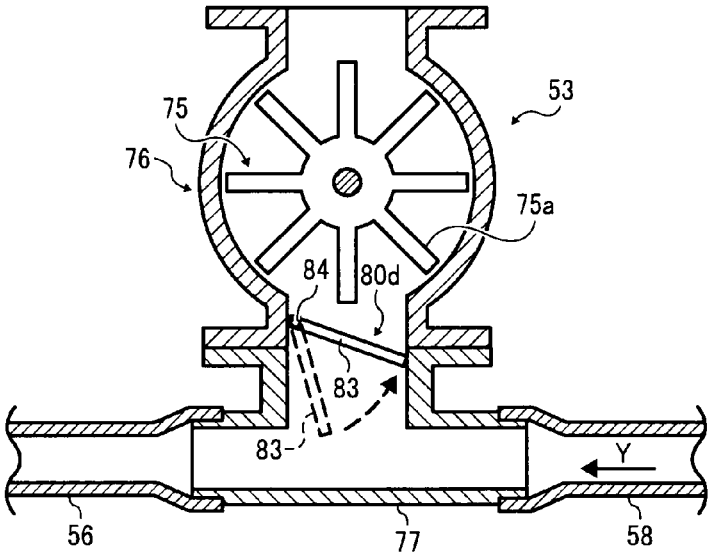
Figure 8C:
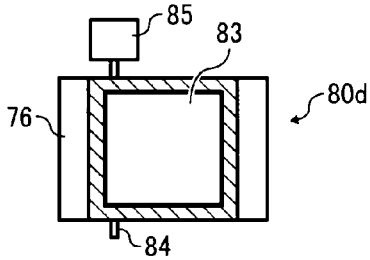

FIGS. 8A through 8C are schematic diagrams illustrating a still another example of an airflow regulator 80*d*. The airflow regulator 80*d* includes a single plate 83 with one end free and another end secured to a motor-driven shaft 84 rotatably supported on the inner wall of the stator 76.

As shown in FIGS. 8A and 8B, the airflow regulator 80*d* is used in conjunction with a valve 86 disposed in the delivery path between the air pump 54 and the joint tube 77. The valve 86 has an internal flow path electrically controlled to alternately direct incoming airflow outward (indicated by arrow "X" in FIG. 8A) and inward (indicated by arrow "Y" in FIG. 8B) the air tube 58 at given intervals, thereby discontinuously supplying compressed air from the air pump 54 to the delivery path.

Further, the airflow regulator 80*d* has a motor 85 to control rotation of the shaft 84 as shown in FIG. 8C. The motor-rotated shaft 84 and the electrically controlled valve 86 are synchronously turned on and off by a suitable control, not shown, so as to effectively regulate the airflow in the delivery path.

Specifically, when the valve 86 shifts the airflow in the X direction and stops the supply of compressed air to the delivery path, the motor 85 concurrently turns the airflow regulator 80*d* to a first position as shown in FIG. 8A, which allows particles dispensed from the rotary feeder 53 to pass the junction zone to the delivery path.

When the valve 86 shifts the airflow in the Y direction and starts the supply of compressed air to the delivery path, the motor 85 concurrently turns the airflow regulator 80*d* to a second position as shown in FIG. 8B. The airflow regulator 80*d* thus obstructs upward airflow at the junction zone so that little if any of the compressed air can flow into the rotary feeder 53 from the joint tube 77.

The use of the electrically-controlled valve 86 facilitates on/off control of the supply of compressed air in the delivery path. This configuration is particularly advantageous in terms of response time, compared to an arrangement in which the air supply is controlled by switching on/off a motor driving the air pump, which typically suffers from delays in activation/deactivation due to inertia of the driving motor.

Although the illustrated example presents the regulating plate with edges contacting the inner wall of the stator 76 or the joint tube 77, the airflow regulator 83 may be designed to have a clearance of approximately 0.1 millimeter or less between the inner walls and the plate edges. Such a small clearance permits little air to flow into the upstream of the junction zone, which, in practice, becomes filled with a certain amount of particles dispensed from the rotary feeder 53 as noted previously.

As mentioned above, the developing system according to this patent specification discontinuously supplies compressed air for particle delivery in the delivery path featuring the airflow regulator. It is to be noted that such discontinuous air supply results in an increase, not a decrease, in feed rate of the delivery path, compared to a configuration in which an air pump substantially identical to that employed in the illustrated examples (in terms of size, rotation speed, and airflow rate) continuously supplies compressed air without using an airflow regulator to prevent air leakage. This can be explained by the fact that leaking air from the delivery path to the rotary feeder not only causes a loss of compressed air used for delivery, but also obstructs flow of particles from the mixing hopper, leading to a significant decrease in average feed rate of the rotary feeder even when the compressed air is continuously supplied.

Figure 9:
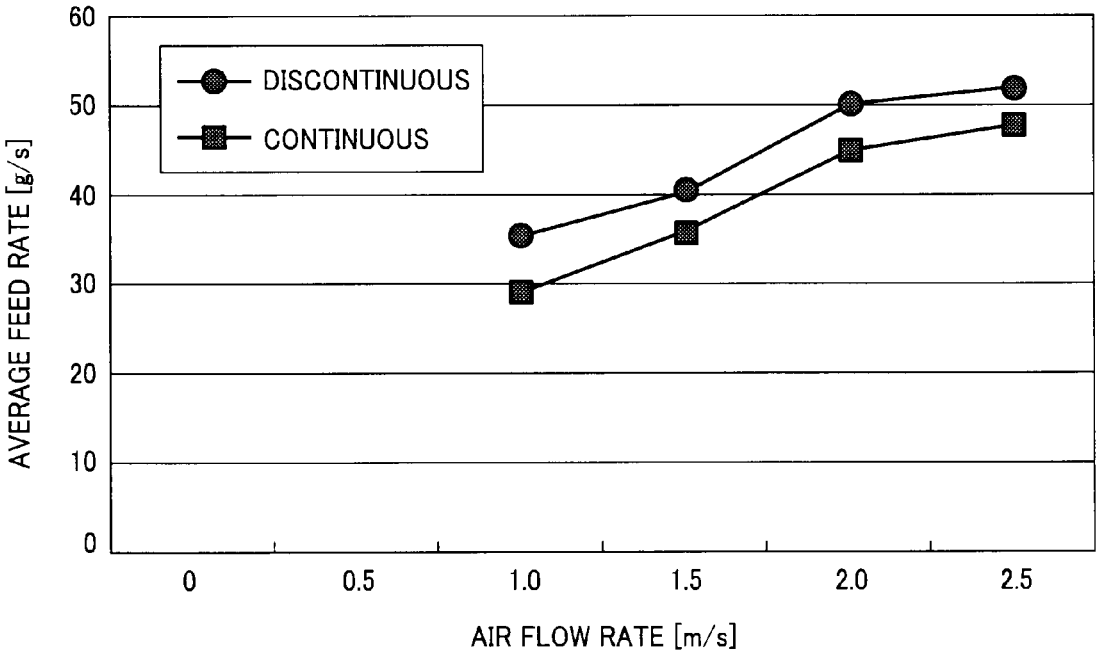
FIG. 9 shows results of an experiment conducted to evaluate developer delivery performance of the developing system illustrated in FIGS. 8A through 8C.

FIG. 9 shows results of an experiment conducted to evaluate the developer delivery performance of the developing system illustrated in FIGS. 8A through 8C in comparison with a configuration that does not have an airflow regulator.

The experimental arrangements used were generally similar to that depicted in FIG. 2, one with the air pump and the motor-driven airflow regulator concurrently switched on and off at an interval of 0.5 seconds ("DISCONTINUOUS"), and the other with the air pump continuously supplying compressed air to a delivery path where an airflow regulator is not provided ("CONTINUOUS"). In the experiment, the rotary feeder was continuously driven, although the rotary feeder 53 in the illustrated examples may operate discontinuously in synchronization with the air pump.

As shown in FIG. 9, the average feed rate of the arrangement with discontinuous air supply was better than that observed for the one with continuous air supply, demonstrating the efficacy of the airflow regulator according to this patent specification.

Thus, the developing system according to this patent specification can deliver developer with compressed air efficiently and reliably through use of the airflow regulator, which prevents leakage of air from the delivery path to the mixing hopper to reduce loss of compressed air used for developer delivery.

Numerous additional modifications and variations are possible in light of the above teachings. It is therefore to be understood that, within the scope of the appended claims, the disclosure of this patent specification may be practiced otherwise than as specifically described herein.

What is claimed is:

1. A developing system, comprising:

a developing unit configured to convert a latent image into visible form using a developer;

a container separated from the developing unit and configured to hold the developer, wherein the container comprises a mixing container that mixes part of the developer after use;

a rotary feeder configured to dispense the developer from the container to a delivery path;

an air pump configured to supply compressed air to deliver the dispensed developer to the developing unit through the delivery path; and an airflow regulator located where the rotary feeder connects to the delivery path, and configured to prevent the compressed air from flowing toward the rotary feeder from the delivery path.

2. The developing system according to claim 1, wherein the airflow regulator includes a plate inclined relative to a direction in which the delivery path guides the compressed air from the air pump so as to prevent airflow from entering the rotary feeder.

3. The developing system according to claim 2, wherein the plate is inclined at an acute angle relative to the direction in which the delivery path guides the compressed air from the air pump.

4. The developing system according to claim 1, wherein the airflow regulator includes multiple plates disposed parallel to and spaced apart from each other at set intervals, each of the plates inclined relative to a direction in which the delivery path guides the compressed air from the air pump so as to prevent airflow from entering the rotary feeder.

5. The developing system according to claim 4, wherein each plate is inclined at an acute angle relative to the direction in which the delivery path guides the compressed air from the air pump.

6. The developing system according to claim 1, wherein the airflow regulator is movable between first and second positions and automatically moves to the first position when the compressed air flows in the delivery path, the first position hindering the compressed air from flowing toward the rotary feeder from the delivery path, and the second position allowing the developer dispensed from the rotary feeder to flow into the delivery path.

7. The developing system according to claim 6, wherein the airflow regulator maintains the second position except when the compressed air pneumatically sets the airflow regulator to the first position.

8. The developing system according to claim 7, wherein the airflow regulator maintains the second position by its own weight.

9. The developing system according to claim 6, further comprising a motor configured to selectively set the airflow regulator to the first and second positions.

10. The developing system according to claim 6, wherein the airflow regulator moves to the second position without bringing a movable end thereof into contact with surroundings of the airflow regulator.

11. The developing system according to claim 6, further comprising a valve located in the delivery path and switched on and off to discontinuously supply compressed air in the delivery path.

12. An image forming apparatus, comprising:

an electrophotographic system configured to form an electrostatic latent image; and a developing system configured to develop the electrostatic latent image, the developing system including:

a developing unit configured to convert the electrostatic latent image using a developer;

a container separated from the developing unit and configured to hold the developer, wherein the container comprises a mixing container that mixes part of the developer after use;

a rotary feeder configured to dispense the developer from the container to a delivery path;

an air pump configured to supply compressed air to deliver the dispensed developer to the developing unit through the delivery path; and an airflow regulator located where the rotary feeder connects to the delivery path, and configured to prevent the compressed air from flowing toward the rotary feeder from the delivery path.

13. The image forming apparatus according to claim 12, wherein the airflow regulator includes a plate inclined relative to a direction in which the delivery path guides the compressed air from the air pump so as to prevent airflow from entering the rotary feeder.

14. The image forming apparatus according to claim 13, wherein the plate is inclined at an acute angle relative to the direction in which the delivery path guides the compressed air from the air pump.

15. The image forming apparatus according to claim 12, wherein the airflow regulator includes multiple plates disposed parallel to and spaced apart from each other at set intervals, each of the plates inclined relative to a direction in which the delivery path guides the compressed air from the air pump so as to prevent airflow from entering the rotary feeder.

16. The image forming apparatus according to claim 15, wherein each plate is inclined at an acute angle relative to the direction in which the delivery path guides the compressed air from the air pump.

17. The image forming apparatus according to claim 12, wherein the airflow regulator is movable between first and second positions and automatically moves to the first position when the compressed air flows in the delivery path, the first position hindering the compressed air from flowing toward the rotary feeder from the delivery path, and the second position allowing the developer dispensed from the rotary feeder to flow into the delivery path.

18. The image forming apparatus according to claim 17, wherein the airflow regulator maintains the second position except when the compressed air pneumatically sets the airflow regulator to the first position.

19. The image forming apparatus according to claim 18, wherein the airflow regulator maintains the second position by its own weight.

20. The image forming apparatus according to claim 17, further comprising a motor configured to selectively set the airflow regulator to the first and second positions.

21. The image forming apparatus according to claim 17, wherein the airflow regulator moves to the second position without bringing a movable end thereof into contact with surroundings of the airflow regulator.

22. The image forming apparatus according to claim 17, further comprising a valve located in the delivery path and switched on and off to discontinuously supply compressed air in the delivery path.

23. An image forming apparatus, comprising:

an electrophotographic system configured to form an electrostatic latent image; and a developing system configured to develop the electrostatic latent image, the developing system including:

a developing unit configured to convert the electrostatic latent image using a developer;

a container separated from the developing unit and configured to hold the developer;

a rotary feeder configured to dispense the developer from the mixing container to a delivery path;

an air pump configured to supply compressed air to deliver the dispensed developer to the developing unit through the delivery path; and a plate located where the rotary feeder connects to the delivery path, and inclined relative to a direction in which the delivery path guides the compressed air from the air pump so as to prevent airflow from entering the rotary feeder.

24. The image forming apparatus according to claim 23, wherein the plate is inclined at an acute angle relative to the direction in which the delivery path guides the compressed air from the air pump.

* * * * *